US005330074A

United States Patent [19]

Wirsig et al.

[11] Patent Number: 5,330,074

[45] Date of Patent: Jul. 19, 1994

[54] APPARATUS FOR DISPENSING FLOWABLE MATERIALS FROM A POUCH

[75] Inventors: Ralph C. Wirsig, Kingston; David C. King, Bath, both of Canada

[73] Assignee: Du Pont Canada Inc., Mississauga, Canada

[21] Appl. No.: 50,254

[22] PCT Filed: Nov. 13, 1991

[86] PCT No.: PCT/CA91/00408

§ 371 Date: May 29, 1993

§ 102(e) Date: May 12, 1993

[87] PCT Pub. No.: WO92/08670

PCT Pub. Date: May 29, 1992

[30] Foreign Application Priority Data

Nov. 16, 1990 [GB] United Kingdom ..... 9024916

[51] Int. Cl.[5] ..... B67D 5/00

[52] U.S. Cl. ..... 222/82; 222/83.5; 222/95; 222/325; 222/386

[58] Field of Search ..... 222/82, 83.5, 95, 105, 222/325, 386

[56] References Cited

U.S. PATENT DOCUMENTS

| | | | |
|---|---|---|---|
| 3,288,333 | 11/1966 | Valk, Jr. | 222/95 |
| 3,815,787 | 6/1974 | Spies | 222/95 |
| 4,136,801 | 1/1979 | Pavenick | 222/82 |
| 4,840,293 | 6/1989 | Segatz | 222/386 X |
| 5,161,715 | 11/1992 | Giannuzzi | 222/95 X |

FOREIGN PATENT DOCUMENTS

| | | | |
|---|---|---|---|
| 1108102 | 5/1961 | Fed. Rep. of Germany . | |
| 3826887 | 2/1990 | Fed. Rep. of Germany . | |
| 823413 | 1/1938 | France | 222/95 |
| 2048888 | 3/1971 | France . | |
| 0669165 | 2/1989 | Switzerland | 222/95 |
| 2988998 | 6/1982 | United Kingdom | 222/95 |
| 2090336 | 7/1982 | United Kingdom | 222/95 |
| 2186544 | 8/1987 | United Kingdom | 222/95 |
| 7900430 | 7/1979 | World Int. Prop. O. . | |

*Primary Examiner*—Gregory L. Huson
*Attorney, Agent, or Firm*—Konrad S. Kaeding

[57] ABSTRACT

An improved piston for a pouch dispenser is disclosed. The dispenser is adapted to contain a pouch of flowable material, and has a lid to keep the pouch within the dispenser and a piston which is adapted to move toward the lid and press against a first end of the pouch, and push the flowable material out of the pouch through a hole in the second end of the pouch. The piston has a peripheral lip extending towards the second end of the pouch. The peripheral lip extends for a length sufficient to cause the film from which the pouch is made to pleat in a direction transverse from which the pouch is made to pleat in a direction transverse to the longitudinal axis of the dispenser when the material in the pouch is squeezed from the pouch by the pressing action of the piston. The lid and piston are adapted to allow the peripheral lip to nest with the lid and to prevent the pleats from hindering essentially all of the material from being squeezed out of the pouch.

4 Claims, 3 Drawing Sheets

APPARATUS FOR DISPENSING FLOWABLE MATERIALS FROM A POUCH

Figure 1:
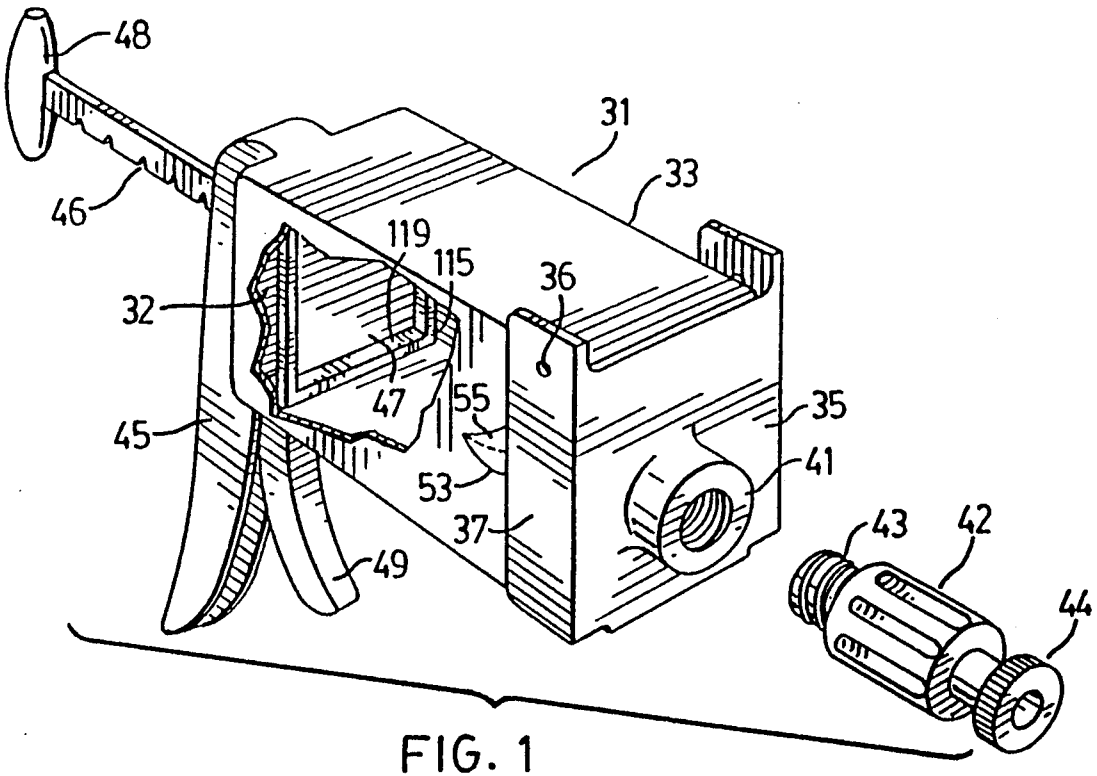

The present invention relates to an apparatus for dispensing flowable materials from a pouch. The pouches are pillow-shaped with "ears".

It is well known to package flowable materials, for example, milk, on so-called vertical form and fill machines. Using such a machine, a flat web of synthetic thermoplastic film is unwound from a roll and formed into a continuous tube in a tube forming section, by sealing the longitudinal edges of the film together to form a so-called lap seal or a so-called fin seal. The tube thus formed is pulled vertically downwards to a filling station. The tube is then collapsed across a transverse cross-section of the tube, the position of the cross-section being at a sealing device below the filling station. A transverse heat seal is made, by the sealing device, at the collapsed portion of the tube, thus making an airtight seal across the tube. The sealing device generally comprises a pair of jaws. After making the transverse seal, but before the jaws of the sealing device are opened, a quantity of material to be packaged, e.g. liquid, is caused to enter the tube, at the filling station, and fill the tube upwardly from the aforementioned transverse seal. The tube is caused to move downwardly a predetermined distance. Such movement may be under the influence of the weight of the material in the tube, or may be caused by pulling or mechanically driving the tube. The jaws of the sealing device are closed again, thus collapsing the tube at a second transverse section. The second transverse section may be above, usually just above, the air/material interface in the tube, or the second transverse section may be below the air/material interface. The sealing device seals and severs the tube transversely at the second transverse section. The material-filled portion of the tube is now in the form of a pillow shaped pouch. Thus the sealing device has sealed the top of the filled pouch, sealed the bottom of the next-to-be formed pouch, all in one operation. One such vertical form and fill machine of the type described above is sold under the trade mark PREPAC. With some other machines, the sealing device does not sever the tube at the second transverse section, but does sever the tube subsequently. With some machines the filling of the tube is done continuously rather than intermittently. The portions of the pouch at the ends of the transverse seals are often referred to as "ears".

For many years, milk has been packaged in pouches made on vertical form and fill machines. Such pouches have been sold to household consumers and, in use, such milk-filled pouches are stood within an open-mouthed pitcher. More recently, such pouches have been used to package other flowable comestibles, mayonnaise, salad dressings, preserves and the like. Pouches containing such comestibles are usually sold to "institutional" buyers, e.g. restaurants. Heretofore the flowable materials have been removed from such pouches by cutting an ear of the pouch and pouring or squeezing the flowable material out of the pouch. Alternatively the pouch has been fitted with a pouring spout such as that disclosed in Canadian Patent 1 192 164 to L. Obidniak.

A further dispensing apparatus is described in United Kingdom patent application 90.09846 to Du Pont Canada Inc., dated 1990 May 2. This application discloses a dispenser apparatus for removing flowable material from a pouch, said pouch having an ear at each of the ends of a transverse seal located at one end of the pouch, said dispenser comprising i) a tubular container having sides and an open top having a rim, said container being adapted to contain said pouch, ii) a lid attachable to the rim such that the lid is adapted to trap the ears of the pouch between the lid and the rim and to keep said end of the pouch taut between said ears when said lid is attached to the rim, said lid also being adapted to allow a spout to pierce said pouch at said taut portion. In one embodiment the tubular container has a bottom comprising a piston disk adapted to move towards the top of the container. Dispensers of the piston type are much preferred and it is to this type that the present invention is directed.

It will be appreciated that it is desirable to squeeze as much material out of the pouch as possible in order to minimize wastage. It is not greatly material what surface the piston presents to the pouch adjacent thereto, in terms of ability to squeeze the bulk of the material from the pouch. However, it has been found that the shape of the periphery of the piston is important in terms of squeezing the "last drops" of material from the pouch.

Accordingly the present invention provides a kit for a pouch dispenser, in which the pouch dispenser is adapted to contain a pouch, the pouch being made from a flexible film and containing a flowable material, said kit comprising a) a tube, b) a lid for the tube, wherein the lid has an orifice for a nozzle and c) a piston which is adapted to move within the tube in the direction of the longitudinal axis of the tube, and wherein the piston is adapted to press against a first end of the pouch and push the flowable material out of the pouch through an orifice in the second end of the pouch and thence through the orifice in the lid, and wherein the piston has a peripheral lip extending towards the lid, said lip being adapted to peel film from adjacent the inner surface of the tube, and extends for a length sufficient to cause the film to pleat in a direction transverse to the longitudinal axis of the dispenser when the piston is moved towards the lid and material in the pouch is squeezed from the pouch by the pressing action of the piston; said wherein the lid is adapted to receive the peripheral lip of the piston, and furthermore the lid and piston together are adapted to cooperate and receive the pleats of the film.

In one embodiment the tube has a cross-section which is essentially square, with rounded corners.

In another embodiment the tube has sides and an open top having a rim, and the lid is attachable to the rim such that the lid is adapted to trap ears of the pouch between the lid and the rim and to keep the pouch taut between said ears when said lid is attached to the rim, said lid also being adapted to allow a spout to be inserted through the orifice in the lid and to pierce the pouch at the taut portion.

In a further embodiment the lid is hingedly attached to the tube.

In yet another embodiment the lid is separate from the tube and attachable to the rim with a snapfit closure.

The invention may be more readily understood by reference to the drawings in which:

FIG. 1 shows a three quarter view, partly cut away, of a container used with the present invention. The container has a hinged lid and a detachable spout.

FIGS. 2*a*, 2*b*, 2*c* and 2*d* show a manner of using the container of FIG. 1.

Figure 3A:
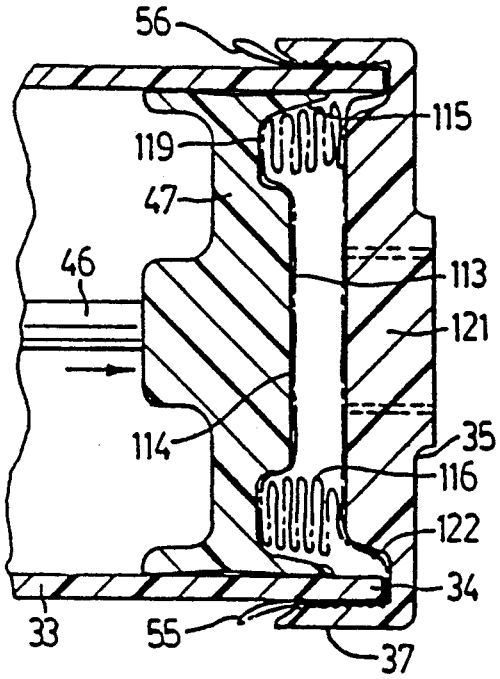
Figure 3B:
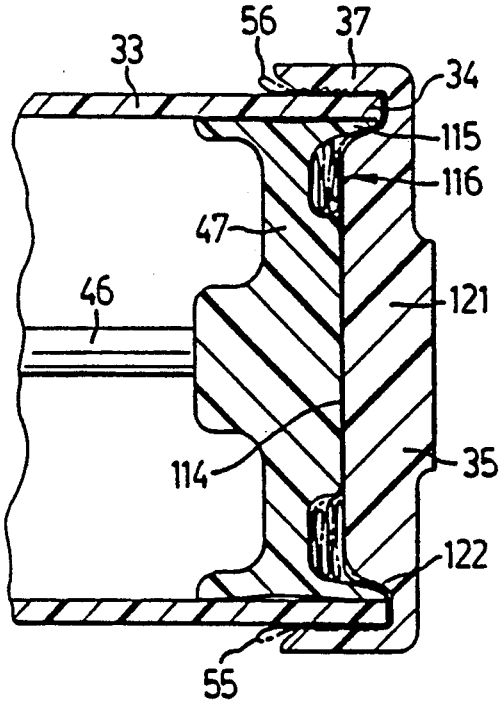

FIGS. 3*a* and 3*b* show part of a dispenser the present invention, in cross-section, which may be used in conjunction with the container of FIG. 1.

Figure 4A:
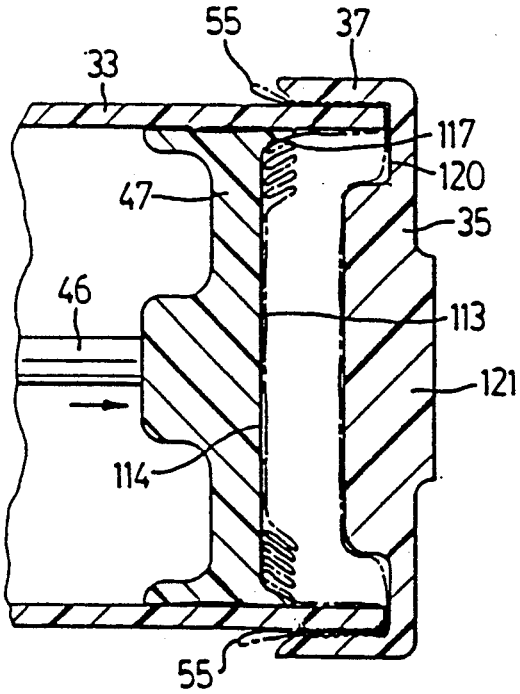
Figure 4B:
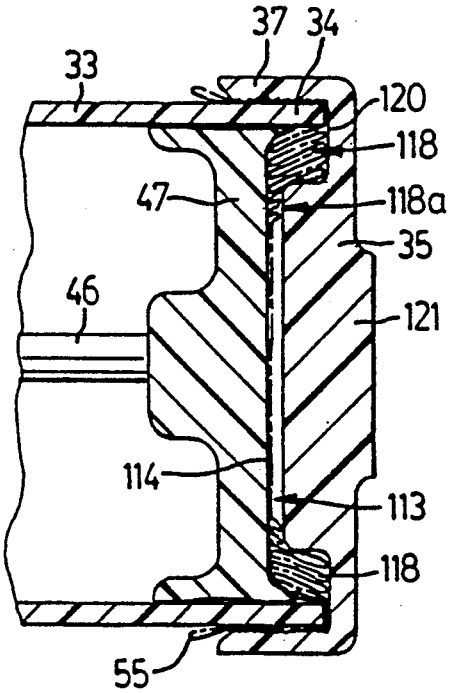

FIGS. 4*a* and 4*b* show a dispenser, not of the present invention, in cross-section.

Figure 2A:
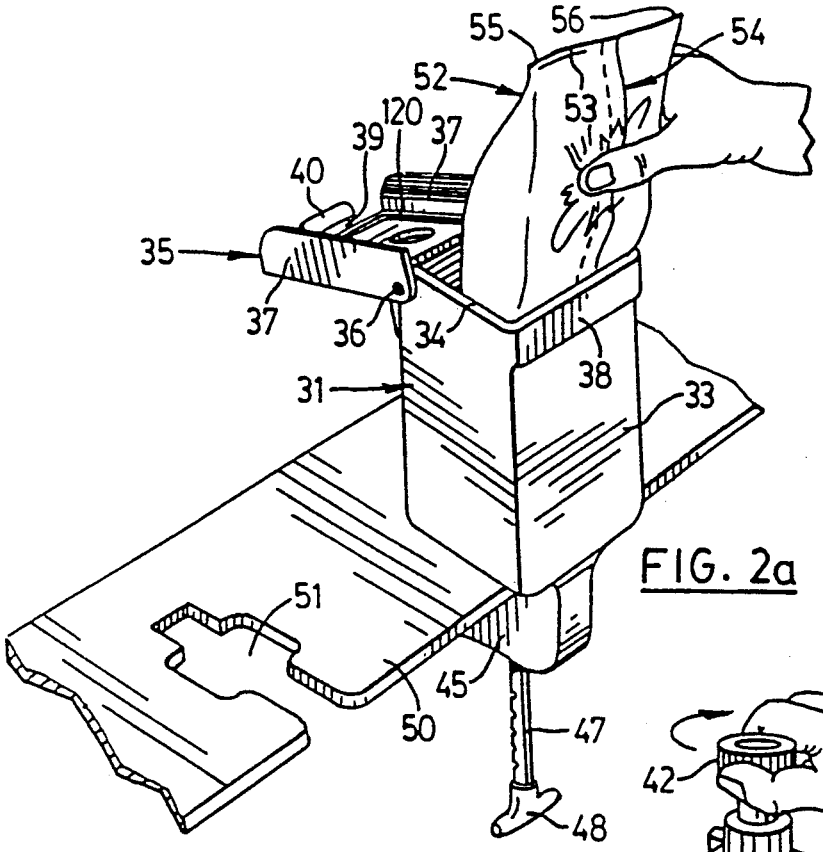
Figure 2C:
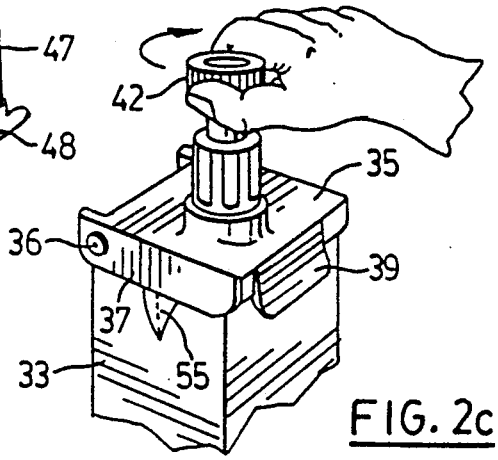
Figure 2B:
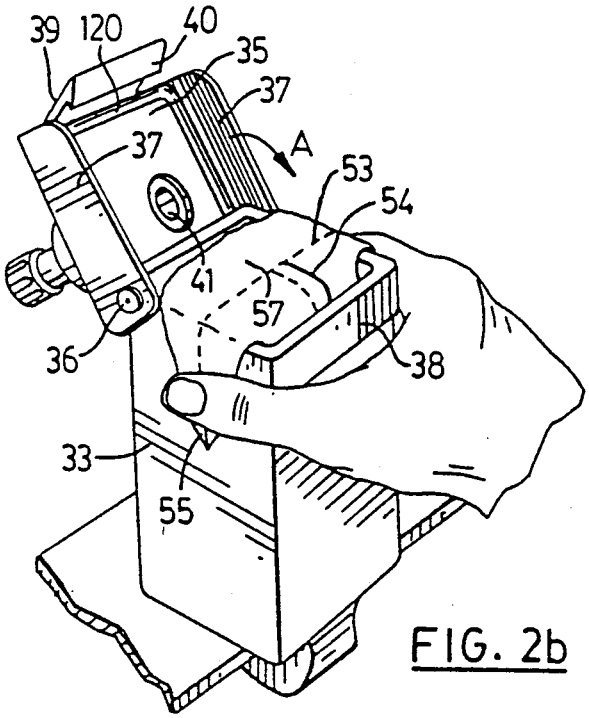

FIGS. 1 and 2*a* show a system suitable for dispensing sour cream, mayonnaise and the like from a pouch. The system comprises container 31 having a bottom 32 joined integrally to tubular container 33. Tube 33 has a top rim 34. Lid 35 is attached to tube 33 by hinge post 36. Lid 35 also has side skirts 37. Tube 33 also has a transverse lip 38 on the side of the cylindrical tube furthest away from hinge posts 36. Lid 35 has a tab 39 with a latching piece 40 attached thereto. Latching piece 40 is adapted to latch under transverse lip 38 when lid 35 is closed as shown in FIG. 2*c*. A threaded conduit 41 is inserted into orifice 121 and is thus joined to lid 35. Into conduit 41 may be inserted spout 42 which has a threaded end 43 and a nozzle 44. Threaded end 43 is for screwing into the threaded portion of conduit 41. Bottom 32 has a handle 45 joined thereto. In the base of the handle and through bottom 32 passes ratcheted spindle 46. Spindle 46 is attached, inside cylindrical tube 33, to piston disk 47. At the end of spindle 46, distal to disk 47, is attached T-handle 48. Trigger 49 is attached to a pawl (not shown) so that spindle 46 may be moved, and thus piston disk 47 be advanced towards lid 35. In FIG. 1, piston disk 47 is shown as having a peripheral lip 115 and a circumferential channel 119. In FIGS. 2*a* and 2*b*, lid 35 is shown as having circumferential channel 120. Circumferential channels 119 and 120 may both be present or only one may be present for operation of the invention. The function of the channel or channels is to provide space for film pleats to nest as will be described in more detail.

Figure 2D:
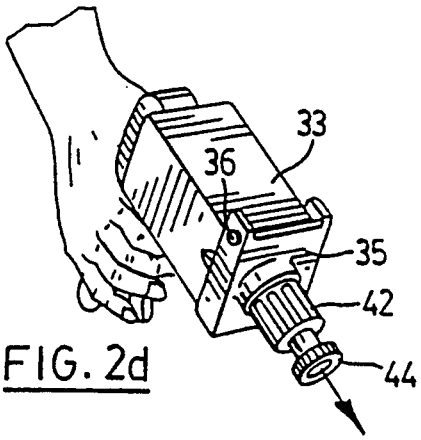

The operation of the container of FIG. 1 for dispensing material is described more fully by reference to FIGS. 2*a* to 2*d*. Container 31 is placed upright in rack 50 having a cut-out 51 adapted to aid in holding container 31 upright. Container 31 is held upright by means of bottom 32 being flush with the upper surface of rack 50, i.e. stands on rack 50 under the influence of gravity. Lid 35 is opened as shown in FIG. 2*a*. Pouch 52 of flowable material, e.g. sour cream, has two transverse end seals, one of which is shown as 53. The pouch is made from a flat web of thermoplastic polymeric material, e.g. polyethylene, and formed longitudinally into a tube. In the embodiment shown in FIG. 2*a* the tube is sealed with a longitudinal seal 54 and then transversely sealed with seals 53. The transverse seal forms "ears" 55 and 56. As shown in FIG. 2*a*, pouch 52 is dropped into container 31. The ears of the pouch 55 and 56 are stretched over the top rim 34 of cylindrical tube 33 as shown in FIG. 2*b*. Lid 35 is swung over, following arrow A in FIG. 3*b* until latching piece 40 of tab 39 engages with transverse lip 38. Lid 35 then firmly grips ears 55 and 56 and traps them between rim 34, skirts 37 and lid 35 as shown in FIG. 2*c*. Thus the top 57 of pouch 52 is held taut between ears 55 and 56. The pouch itself is filled so that the contents are not under pressure. In the embodiment shown in FIG. 2*c*, spout 42 is already attached to conduit 41. Conduit 41 may be off-centre in the lid so that the nozzle 44 does not sit over the longitudinal seal 54 or the transverse seal 53. By twisting nozzle 44 the pointed end of a threaded end or a saw-toothed end of spout 42 is caused to penetrate the taut portion of the top 57 of pouch 52. Because the pouch is not under pressure, the contents of the pouch remain within the pouch without leakage. If the pouch was under pressure there may be a risk of the contents squirting out into the interior of container 33. By a mechanism and process described in the aforementioned United Kingdom patent application 90.09846 the threaded end or saw-toothed end of the spout is sealed to the pouch so that material does not spill into the container. The container, with pouch therein is then ready for use. The threaded-end type spout is preferred for films which are less stretchy, e.g. polyethylene films laminated to ethylene-vinyl alcohol copolymer films. As shown in FIG. 2*d*, the dispenser may be grasped by hand using handle 45. In order to force material from the pouch, trigger 49 is manually squeezed, thus causing the ratchet mechanism to move piston disk 47 towards lid 35 and squeeze material from the pouch through spout 42 and nozzle 44 as a result of the hydraulic pressure within the pouch.

As indicated hereinbefore, it has been found that it is advantageous for the pouch to fold or pleat such that the pleats layer with their folds in a direction transverse to the direction of travel of the piston, i.e. transverse to tile longitudinal axis of the container. It has been found that a lip at the periphery of the piston, on the side facing the pouch, allows the film of tile pouch to so fold. However, if the lip does not extend far enough, the film folds such that the pleats layer with their folds in a direction parallel to the direction of travel of the piston, i.e. parallel to the longitudinal axis of the container. The extension of the lip may be found by simple experimentation.

FIGS. 3*a* and 3*b* show a piston lip which is suitable for folding the film appropriately, i.e. with folds layered transversely to the longitudinal direction of the dispenser. Piston 47 is attached to ratchet spindle 46. Piston 47 is adapted to travel between walls of tube 33. Piston 47 has a peripheral lip 115 which contacts the inner wall of tube 33. In addition to peripheral lip 115 there is a circumferential channel 119 which is wide enough and deep enough to accommodate film pleats 116. Lid 35 has a circumferential channel 122 which is adapted to receive peripheral lip 115, as shown in FIG. 3*b*. The bottom end 113 of pouch 52 is shown resting on piston face 114. Lid 35 is removably attached to the rim 34 of tube 33. As will be seen, ears 55 and 56 are trapped between rim 34, skirt 37 and lid 35. When piston 47 is pushed in the direction of the arrow, the bottom of the pouch is forced towards lid 35. The length of lip 115, measured from the bottom of channel and shape of lip 115 is such that it causes the film of the pouch to layer in pleats 116. As will be seen by comparing FIGS. 3*a* and 3*b*, such layering allows the material to be squeezed fully out of the pleats towards orifice 121. The pleats fold into channel 119 so that the pleats are not caught between the piston disk 47 and lid 35. Thus, more of the material is dispensed from the pouch than would otherwise be the case.

FIGS. 4*a* and 4*b* show a dispenser with a piston which has a lip which is not suitable for folding the film appropriately, i.e. it causes folds to be layered transversely to the longitudinal direction of the dispenser. Piston 47 is attached to ratchet spindle 46. Piston 47 is adapted to travel between walls of tube 33. Piston 47 has a peripheral lip 117 which contacts the inner wall of tube 33. In addition to peripheral lip 117. There is a circumferential channel 118 which accommodates peripheral lip 117. It is also wide enough and deep enough to accommodate film pleats 118, although there are some deficiencies in its ability to fully accommodate the film pleats 118. The bottom end 113 of pouch 52 is shown resting on piston face 114. Lid 35 is removably attached to the rim 34 of tube 33. As will be seen, ears 55 and 56 are trapped between rim 34, skirt 37 and lid 35. When piston 47 is pushed in the direction of the arrow, the bottom of the pouch is forced towards lid 35. The length of lip 117, measured from face 114 and the shape of lip 117 is such that it causes the film of the pouch to layer in pleats 118. Such pleats are folded parallel to the longitudinal axis of tube 33. It has been found that, as shown in FIG. 4*b*, the pleating tends to peter out, as a 118*a*, rather than remain in a defined width, as is the case in FIG. 3*b*. The petered-out pleating 118*a* does not allow face 114 and lid 35 to come close enough to dispense. If channel 120 is widened to accommodate this petering out of pleats 118, then there is a portion of channel 120 which is not fully filled with pleats and this, too, leads to not all of the remains of the material from being dispensed from the pouch. This type of pleating allows less of the material in the pouch to be dispensed than is the case with pleating transverse to the longitudinal axis of tube 33.

The present invention is useful for dispensing flowable materials. The term "flowable material" does not include gases but encompasses materials which are flowable under gravity or may be pumped or extruded. Such materials include emulsions, e.g. ice cream mix; soft margarine; food dressings; pastes; preserves, e.g. doughnut fillings; jellies; detergents; caulking materials; and liquids, e.g. milk; oils. The dispenser of FIGS. 1 and 2 is suitable, for portion control of products such as mayonnaise, ketchup, mustard, relish, sour cream, e.g. 28 ml portions of sour cream dispensed from a 680 ml pouch onto a taco. Using a dispenser with a small lip on the periphery, there is about 2.25 to 2.5% wastage inside the pouch and another 1.5% wastage left in the nozzle neck. Using the present invention it is possible to reduce such wastage inside the pouch to about 1.5%.

EXAMPLE

A dispenser similar to that shown in FIG. 1 was constructed, about 15.3 cm long, having a square cross-section of 7.3 cm between opposing walls and having rounded corners to the square, each rounding having a radius of 43 mm. The dispenser was fitted with snugly fitting pistons.

In one experiment the face of the piston was for the most part flat, with a peripheral lip as shown in FIG. 3. The piston also had a channel therein adjacent to the lip, 3.8 mm deep and about 8 mm wide, to accommodate the pleats. The peripheral lip extended 8.9 mm from the bottom of the channel.

In a second experiment the face of the piston was flat with a peripheral lip as shown in FIG. 4, which extended 2.8 mm from the face. The lid had a channel therein to accommodate pleats in the film and the peripheral lip of the piston.

Pouches of sour cream were inserted into the dispenser and the pistons were used to squeeze the sour cream out of the pouch. The amounts of sour cream originally in the pouch and also that left in the pouch were measured, and the percentage sour cream left in the pouch calculated. The results were 1.5% for the first experiment and 2.5% for the second. On inspection of the pouches used in the first experiment, the pleats of the film of the pouches layered transversely to the longitudinal axis of the dispenser. In the second experiment the pleats were layered parallel to the longitudinal axis. It will be seen that the result for the dispenser used in the first experiment was the best. The dispenser used in the first experiment falls within the scope of the invention but the second does not.

We claim:

1. A dispenser for flowable supplied in pouches of flexible film, comprising:

a) a tube having an inner surface;

b) a lid removably attached to one end of the tube, said lid having an orifice defining a conduit through said lid, and said lid having skirt means for trapping a pouch and holding taut a portion adjacent the orifice of the film of said trapped pouch;

c) a nozzle removably attached to the orifice;

d) a puncture means on said nozzle for piercing the taut portion of film of said trapped pouch;

e) a piston within the tube adapted to move toward and away from the one end of the tube in directions parallel to the longitudinal axis of the tube, said piston having a peripheral lip means, facing said one end of the tube, for peeling the film of said pouch adjacent the inner surface of the tube by advancement of the piston toward said one end of said tube, said lip means having a length sufficient for causing said peeled film to form pleats in a plane perpendicular to the longitudinal axis of the tube, said piston having a piston channel means for receiving said pleats; and f) a peripheral lid channel on said lid facing said piston and adapted to receive said peripheral lip means.

2. The dispenser of claim 1 wherein the tube has a cross section which is rectangular with filleted corners.

3. The dispenser of claim 1 wherein the lid is hingedly attached to the tube and further wherein the lid and tube have closure means for snapfitting the lid to the one end of the tube.

4. The dispenser of claim 2 wherein the lid is hingedly attached to the tube and further wherein the lid and tube have closure means for snapfitting the lid to the one end of the tube.

* * * * *